US010173143B2

(12) United States Patent
Ferguson

(10) Patent No.: US 10,173,143 B2
(45) Date of Patent: Jan. 8, 2019

(54) MAGNETIC CONSTRUCTION SYSTEM AND METHOD

(71) Applicant: Joshua Willard Ferguson, Alameda, CA (US)

(72) Inventor: Joshua Willard Ferguson, Alameda, CA (US)

( * ) Notice: Subject to any disclaimer, the term of this patent is extended or adjusted under 35 U.S.C. 154(b) by 57 days.

(21) Appl. No.: 14/169,094

(22) Filed: Jan. 30, 2014

(65) Prior Publication Data

US 2014/0213139 A1 Jul. 31, 2014

Related U.S. Application Data

(60) Provisional application No. 61/759,189, filed on Jan. 31, 2013.

(51) Int. Cl.
*A63H 33/04* (2006.01)
*A63H 17/00* (2006.01)

(52) U.S. Cl.
CPC ..... *A63H 33/046* (2013.01); *A63H 17/002* (2013.01)

(58) Field of Classification Search
CPC ..... A63H 33/042; A63H 33/26; A63H 33/046
USPC ..... 446/92
See application file for complete search history.

(56) References Cited

U.S. PATENT DOCUMENTS 3,184,882 A * 5/1965 Vega ..... 446/92
4,024,588 A * 5/1977 Janssen et al. ..... 623/18.12
4,258,920 A * 3/1981 Waldron et al. ..... 273/157 R
4,663,874 A * 5/1987 Sano et al. ..... 40/621
5,009,625 A * 4/1991 Longuet-Higgins ..... 446/92
5,021,021 A * 6/1991 Ballard ..... 446/92
5,337,501 A * 8/1994 Amanze ..... 40/621
5,347,253 A * 9/1994 Ogikubo ..... 335/302
5,409,236 A * 4/1995 Therrien ..... 273/288
5,411,262 A * 5/1995 Smith ..... 273/157 R
5,588,240 A * 12/1996 Zilliox ..... 40/729
5,813,894 A * 9/1998 Tohyama ..... 446/95
5,897,417 A * 4/1999 Grey ..... 446/125
5,947,786 A * 9/1999 Glick ..... 446/85
6,017,220 A * 1/2000 Snelson ..... 434/301
6,024,626 A * 2/2000 Mendelsohn ..... 446/92
6,062,937 A * 5/2000 Kikuchi ..... 446/91
6,241,249 B1 * 6/2001 Wang ..... 273/156
6,548,752 B2 * 4/2003 Pavlenko et al. ..... 174/391
(Continued)

FOREIGN PATENT DOCUMENTS

EP 2060306 A1 5/2009
EP 2189204 A1 5/2010
(Continued)

*Primary Examiner* — John E Simms, Jr.
*Assistant Examiner* — Dolores Collins
(74) *Attorney, Agent, or Firm* — Patent Law Offices of Michael E. Woods; Michael E. Woods

(57) ABSTRACT

A magnetic construction system comprised of plural multi-shaped structural bodies each containing one or more captured magnets, wherein each magnet is free to rotate within its respective retaining pocket to align in magnetic polarity with rotatable magnets in adjacent structural bodies. Surface geometry around each magnet may include a radial detent feature which provides lateral and rotational stability between magnetically coupled structural bodies, or a radial recess which allows free rotation of respective structural bodies about the polar axis of magnetic coupling.

19 Claims, 10 Drawing Sheets

(56) References Cited

U.S. PATENT DOCUMENTS

| | | | | |
|---|---|---|---|---|
| 6,566,992 | B1 * | 5/2003 | Vicentelli | 335/306 |
| 6,626,727 | B2 * | 9/2003 | Balanchi | 446/85 |
| 6,671,986 | B2 * | 1/2004 | Reeves | 40/1.6 |
| 6,747,537 | B1 * | 6/2004 | Mosteller | 335/306 |
| 6,749,480 | B1 * | 6/2004 | Hunts | 446/92 |
| 6,846,216 | B1 * | 1/2005 | Balanchi | 446/85 |
| 6,896,574 | B2 * | 5/2005 | Needham et al. | 446/138 |
| 6,969,294 | B2 * | 11/2005 | Vicentelli | 446/92 |
| 6,975,197 | B2 * | 12/2005 | Creighton, IV | 335/306 |
| 7,066,778 | B2 * | 6/2006 | Kretzschmar | A63H 33/046 446/124 |
| 7,073,232 | B1 * | 7/2006 | Fuhrman et al. | 24/303 |
| 7,156,663 | B1 * | 1/2007 | Gerhart | 434/74 |
| 7,160,170 | B2 * | 1/2007 | Yoon | 446/92 |
| 7,234,986 | B2 * | 6/2007 | Kowalski | A63H 33/12 446/111 |
| 7,247,075 | B2 * | 7/2007 | von Oech | 446/92 |
| 7,255,624 | B2 * | 8/2007 | Daftari | 446/92 |
| 7,273,404 | B2 * | 9/2007 | Kowalski et al. | 446/92 |
| 7,276,270 | B2 * | 10/2007 | Vicentelli | 428/36.9 |
| 7,322,873 | B2 * | 1/2008 | Rosen et al. | 446/91 |
| 7,371,147 | B2 * | 5/2008 | Tusacciu | 446/85 |
| D575,833 | S * | 8/2008 | Fink et al. | D21/563 |
| 7,413,493 | B2 * | 8/2008 | Toht et al. | 446/92 |
| 7,507,136 | B2 * | 3/2009 | Patton | 446/92 |
| 7,559,821 | B2 * | 7/2009 | Pacheco | 446/108 |
| 7,785,168 | B2 * | 8/2010 | Yamada et al. | 446/376 |
| 7,955,155 | B2 * | 6/2011 | Tremblay | A63H 33/046 446/85 |
| 7,985,116 | B2 * | 7/2011 | Song et al. | 446/92 |
| 8,061,713 | B2 * | 11/2011 | Cook | 273/157 R |
| 8,062,088 | B2 * | 11/2011 | Perry | 446/139 |
| 8,070,550 | B2 | 12/2011 | Song et al. | |
| 8,128,452 | B2 * | 3/2012 | Kim et al. | 446/92 |
| 8,292,687 | B2 * | 10/2012 | Tremblay et al. | 446/92 |
| 8,340,774 | B2 * | 12/2012 | Hochmair et al. | 607/57 |
| 8,348,279 | B2 * | 1/2013 | Burton | 273/157 R |
| 8,458,863 | B2 * | 6/2013 | Hunts | 24/303 |
| 8,491,312 | B2 * | 7/2013 | Rudisill et al. | 439/39 |
| 8,525,626 | B2 * | 9/2013 | Tait et al. | 335/285 |
| 8,528,903 | B2 * | 9/2013 | Katz | 273/138.2 |
| 8,544,849 | B2 * | 10/2013 | Knell et al. | 273/157 R |
| 8,556,673 | B1 * | 10/2013 | Winting | 446/108 |
| 8,764,508 | B1 * | 7/2014 | Eckard et al. | 446/137 |
| 8,894,459 | B2 * | 11/2014 | Leyland et al. | 446/92 |
| 8,911,276 | B2 * | 12/2014 | Kim et al. | 446/92 |
| 8,986,012 | B1 * | 3/2015 | McGee | G09B 23/02 434/211 |
| 9,339,736 | B2 * | 5/2016 | Howard | G09B 23/18 |
| 2002/0115373 | A1 | 8/2002 | Lazerman | |
| 2010/0120322 | A1 * | 5/2010 | Vicentelli | 446/92 |
| 2012/0164913 | A1 | 6/2012 | Pomeroy et al. | |
| 2013/0050958 | A1 * | 2/2013 | Bdeir | 361/730 |
| 2014/0302741 | A1 * | 10/2014 | Whittaker | 446/92 |
| 2015/0079872 | A1 * | 3/2015 | Howard | A63H 33/046 446/92 |

FOREIGN PATENT DOCUMENTS

| | | |
|---|---|---|
| KR | 100546070 | 1/2006 |
| KR | 200407921 | 2/2006 |
| KR | 2020120009001 | 12/2012 |
| WO | 2006129903 | 7/2006 |
| WO | 2014121012 | 8/2014 |

* cited by examiner

Section view A-A

Detail B
Scale 3:1

Section view D-D
Scale 3:1

Section view F-F

Section view C-C
Scale 3:1

Detail G
Scale 3:1

Section view H-H

Detail I
Scale 3:1

MAGNETIC CONSTRUCTION SYSTEM AND METHOD

CROSS REFERENCE TO RELATED APPLICATIONS

This application claims the benefit of U.S. Provisional Application 61/759,189 filed on Jan. 31, 2013, the contents of which are hereby expressly incorporated by reference for all purposes.

FIELD OF THE INVENTION

This invention relates generally to magnetic construction systems, and more specifically, but not exclusively, to magnetic construction systems using permanent dipole magnets rotatably retained within corresponding pockets in multiple structural bodies which may attract, one to another, via the ability of the respective magnets to rotate as needed for proper orientation and alignment of opposite magnetic poles.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Numerous systems have been designed to allow for repeated construction and deconstruction of structures. Such arrangements generally allow a variety of different parts to work together as a unified system with common attachment geometries or methods allowing individual parts to be reconfigured to create new forms. One common part interlock method used is that of an interference fit, also known as a press-fit. Despite the building flexibilities provided by press-fit attachment methods, there are also some common drawbacks, such as difficulty of assembly, and later disassembly, especially by younger children, and generally the inability to remove an internal part without first removing parts attached thereupon.

Magnetic construction inter-connects can facilitate the process of connecting parts into structures, through natural magnet attraction, as well as the process of detaching parts, even allowing internal, bounded parts to be slid out and replaced. Magnetic construction systems vary significantly in terms of how this magnetic coupling is achieved. Some systems may employ permanent dipole magnets fixed within a structural body with magnet polarity oriented perpendicular to the body surface. As a result, attaching two or more parts requires proper orientation of structural bodies such that magnetic polarities are aligned. However, this fixed dipole arrangement means a user has a 50% chance of needing to flip any given piece prior to attachment. For multilayer systems, it may difficult, if possible, to flip a connecting part, especially parts having multiple magnets which all must have a proper predetermined orientation. For parts that are not manufactured in a specific way with specific magnetic orientations, some construction options are excluded.

Other magnetic construction systems may address this polarity alignment issue by adding an intermediate ferromagnetic piece which can attach equally well to either the north or the south pole of any dipole magnet. However, the need for a separate ferromagnetic part impacts system architecture, ease of construction, safety, and overall cost.

Similarly, some magnetic construction systems may employ loose magnets to attach structural bodies at ferrous attachment points. However, this approach has corresponding shortcomings, and brings up the additional safety concerns associated with the risk of children ingesting two or more loose magnets and having them internally magnetically couple.

A fourth approach could involve a use of captive magnets which are free to rotate within structural bodies, allowing self-alignment of their magnetic polarities when the magnetic fields of adjacent magnets sufficiently overlap, such as when parts are adjacently positioned for magnetic coupling. Some systems could employ cylindrical permanent dipole magnets positioned proximate to linear perimeter edge surfaces of geometric forms, such that the geometric axis of each cylindrical magnet is parallel with an adjacent linear perimeter edge surface, and the polar axis is perpendicular to the geometric axis. Clearance between each magnet and corresponding magnet retaining pocket within the structural body may allow each magnet to swivel freely about its cylindrical axis, allowing the polar axis of any magnet to align with the polar axis of any magnet in an adjacent part. Accordingly, adjacent parts may be able to magnetically couple along their linear perimeter surface segments and to pivot with respect to the linear contact between said perimeter surface segments. This architecture may remove any need to actively orient parts to align magnetic polarity for part coupling. However, one notable result of this architecture in which the rotation axis of the cylindrical magnet is perpendicular to the polar magnetic axis is that two magnetically attached parts find magnetically stable attraction at increments of each 180 degrees; when one part is twisted about the magnetic axis of attachment, the magnets provide rotational resistance (by virtue of the magnetic fields attracting the magnets to a position of parallel cylinders) until the associated magnet has been rotated past 90 degrees, at which point the respective magnetic fields then attract the magnets to the next stable orientation of parallel axes of the cylinders, 180 degrees from the last stable position. This bi-stable coupling behavior may be considered desirable in one respect, by helping part edges to align along their linear edge geometry, but it also means that this magnet architecture it not suitable for applications in which smooth and continuous rotation is desirable, such as with magnetically attached wheels, gears, or chain segments. Furthermore, the combined thickness of two intermediate part walls between coupled magnets reduces magnetic coupling force significantly, therefore requiring larger or stronger magnets for any desired connection strength and commensurately increasing overall system cost.

Some systems may make use of an internally captured spherical dipole magnet which is free to swivel within a retaining pocket to match the polarity of a like magnet in an adjacent piece. Two such magnetically coupled parts could rotate with respect to one another but may experience considerable rotational friction between contact surfaces due to the local clamping load applied by the respective magnets. Again, this could be a shortcoming for applications where low-friction, smooth/continuous rotational movement is desired, such as with wheel or gear axles, and wall thickness would meanwhile detract from magnetic coupling force. Furthermore, such a magnetic coupling may not provide sufficient rotational stability to allow for stable structures, especially when the magnetic coupling axis is oriented horizontally and the weight of attached parts may cause unwanted rotation or bending/sagging of parts about said axis.

Other systems may employ an alternate mechanisms to achieve a similar effect. In one architecture, cylindrical magnets may be orientated with the geometric axis of each magnet perpendicular to the adjacent body surface, and the polar axis of the magnet perpendicular to the geometric axis. Each magnet could freely swivel only about its cylindrical axis, such that the polar axis remains parallel with the respective body surface. If two or more such parts are positioned for magnetic coupling, the respective magnets may self-orient with parallel and opposed polarities. Parts may rotate with respect to one another about this magnetic coupling, via the capability of either magnet to rotate within its retaining pocket, but the interposing surfaces may experience significant friction due to the clamping force exerted by the magnets, thereby resisting rotation, while the wall thickness of the retaining walls detracts from the coupling force of the magnets.

Still other systems may include a rather complex pivotable subassembly comprised of a disc shaped magnet with a polarity coaxial with its geometric axis, and a pivotable carrier which allows the magnet to axially rotate perpendicular to the polar axis so that either magnetic pole may face outward. Two of the magnetic subassemblies may thereby respectively swivel to magnetically align, enabling attachment of corresponding structural bodies. This magnetic coupling may allow relative rotation of either structural body about the shared magnetic axis when an applied rotational force overcomes related friction between contact surfaces. However, this system has no provision for providing rotational stability between coupled structural bodies when so desired, and requires multiple additional parts for the subassembly required in each magnet location.

A further variation may provide that each of the relatively complex pivotable magnet holder subassemblies has built-in circumferential teeth which index with like teeth in other pivotable subassemblies. In this arrangement, relative rotation of magnetically coupled parts is always achieved in an indexed fashion, and is not capable of free rotation when so desired. As before, the part count and complexity of each pivotable magnetic subassembly translates to increased overall cost.

In summary, various magnetic construction systems may employ different mechanisms and methods of aligning magnetic polarity between parts, but not in a manner which comprehensively enables self-alignment of magnets via geometric rotation while also enabling any magnetic coupling to serve either as a freely rotatable, low-friction axis of rotation when desired (such as for wheels, gears, or chains links), or as a rotationally stable connection point with indexed rotation detents suitable for structural stability. Therefore, to provide the greatest utility in further expanding construction capabilities, what is needed is a magnetic construction system with self-aligning, exposed magnets and a capability to allow either free or indexed rotation between magnetically coupled parts.

BRIEF SUMMARY OF THE INVENTION

Disclosed is a magnetic construction system and method including structural bodies capturing partially-exposed, rotatable and self-aligning magnets.

The following summary of the invention is provided to facilitate an understanding of some of the technical features related to the construction and the mechanical and magnetic behavior of the system, but is not intended to be a full description of the present invention. A full appreciation of the various aspects of the invention can be gained by taking the entire specification, claims, drawings, and abstract as a whole. The present invention is applicable to devices and methods other than magnetic construction systems as well as to other magnetic tools, coupling systems, and mechanisms.

Embodiments of the present invention include structural bodies and permanent dipole magnets. Each structural body is constructed of two or more permanently attached structural parts which together form one or more pockets, and each pocket has two equal and opposed outward-facing openings of restricted aperture. These pockets serve to capture a corresponding number of permanent magnets which are free to rotate to magnetically align with magnets in adjacently positioned structural bodies. The outward facing surface of each magnet is partially exposed through the openings with the exposed portions able to contact or to come within close proximity with a like exposed surface of other magnets, thereby increasing magnetic coupling force. Two or more magnetically coupled structural bodies are able to rotate with respect to one another about the axis of magnetic coupling in either an indexed and clicking manner via detents, or alternatively in an arrangement allowing free and smooth rotation between respective parts.

In one implementation, an underlying geometry of each structural body is based on an extended pattern of efficiently nested, equal-sized equilateral triangles, wherein: a) each triangle apex is coincident with the apex of five other like triangles; b) every side of every triangle is coincident with one side of an adjacent triangle; c) any adjacent apex of any triangle, separated by a single triangle side length, represents a possible magnet position within the structural body; d) the perimeter geometry of the structural body surrounding any such magnet position (hereafter 'magnetic node' or 'node') is comprised of one or more radial arcs with said possible magnet locations as center points, with all such radii substantially equal in dimension and substantially equating to half the length of a side of the equilateral triangle. Magnetically coupled nodes therefore share the same underlying equilateral pattern, promoting the ability to efficiently stack or nest structural bodies in a manner consistent with the underlying pattern. Stacking includes the use of multiple overlapping or overlaying planes, each plane conforming to the underlying geometry of the extended pattern with magnet locations aligned across planes. In addition, the geometry of specific parts allows out-of-plane constructions in which two or more planes of the extended pattern may intersect.

With magnets thus positioned centrally within one or more nodes of each structural body, two or more magnetically coupled structural bodies create a shared magnetic axis running through the center of each magnetically coupled node. Any such magnetic axis may serve as an axis about which said structural bodies may rotate in relation to one another.

Furthermore, around the geometric axis extending through opposing magnet pocket openings, the surface of the structural body may be characterized by alternating and axially repeating protrusions and recessed features serving together as detents, such that: 1) two like surfaces of any nodes may nest one into the other in a rotationally stable manner when said nodes are magnetically coupled, and; 2) said nodes may be intentionally rotated with respect to one another without magnetic decoupling; and 3) said rotation may be characterized by discreet rotational clicks provided by said detents. Alternately, in specific structural bodies the geometry around said geometric axis may instead be characterized as a revolved, sunken surface which does not engage with the described detent protrusions of other parts, thereby allowing free rotation without discreet detent clicks.

An embodiment of the present invention includes an apparatus, having a housing providing a plurality of magnetic coupling nodes, the said node defined at a vertex of an equilateral triangular node pattern, said housing having a first face defining a first mating surface centered at the said node, the said first mating surface substantially similar to the other, said housing further including a perimeter wherein a portion of said perimeter proximate the said node includes a node perimeter contour and a portion of said perimeter intermediate a pair of adjacent nodes includes a body perimeter contour different from said node perimeter contour, said body perimeter contour complementary to said node perimeter contour wherein said node perimeter contour nests into said body perimeter contour, said housing further defining a plurality of internal cavities, one internal cavity associated with the said node of said plurality of nodes; and a plurality of permanent dipole magnets, one permanent dipole magnet disposed in the said internal cavity wherein said one permanent dipole magnet disposed in a particular cavity is proximate said first mating surface centered on said node associated with said particular cavity.

Another embodiment of the present invention includes a constructing method including a) positioning a first magnetic constructing device of a set of magnetic constructing devices at a first location, the constructing device of said set of magnetic constructing devices including a housing providing a plurality of magnetic coupling nodes, the said node defined at a vertex of an equilateral triangular node pattern, said housing having a first face defining a first mating surface centered at the said node, the said first mating surface substantially similar to the other, said housing further including a perimeter wherein a portion of said perimeter proximate the said node includes a node perimeter contour and a portion of said perimeter intermediate a pair of adjacent nodes includes a body perimeter contour different from said node perimeter contour, said body perimeter contour complementary to said node perimeter contour wherein said node perimeter contour nests into said body perimeter contour, said housing further defining a plurality of internal cavities, one internal cavity associated with the said node of said plurality of nodes; and a plurality of permanent dipole magnets, one permanent dipole magnet disposed in the said internal cavity with the permanent dipole magnet including a north magnetic pole and a south magnetic pole and with said one permanent dipole magnet disposed in a particular cavity proximate said first mating surface centered on said node associated with said particular cavity; b) positioning a second magnetic constructing device of said set of magnetic constructing devices at said first location with one or more first particular mating surfaces of said first magnetic constructing device proximate to one or more second particular mating surfaces of said second magnetic constructing device; c) rotating said magnets at nodes associated with said particular mating surfaces so a north pole of a first magnet is aligned with a south pole of a second magnet producing one or more magnetic coupling forces; and d) retaining said second magnetic constructing device to said first magnetic constructing device using said one or more magnetic coupling forces.

In at least one embodiment of the present invention, the magnet is spherical in form, and the retaining pocket is accordingly dimensioned to allow said magnet to freely rotate about any axis extending through the center point of said magnet.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally similar elements throughout the separate views and which are incorporated in and from a part specification, further illustrate the present invention and, together with the detailed description of the invention, serve to explain the principles of the present invention.

DETAILED DESCRIPTION OF THE INVENTION

Embodiments of the present invention provide an architecture and method for creating a magnetic construction system including two or more structural bodies each capturing one or more partially exposed, rotatable and self-aligning magnets. The unique structural aspects of the present invention are illustrated herein via various illustrative embodiments, as will now be described in detail. The following description is presented to enable one of ordinary skill in the art to make and to use the invention, and is provided in the context of a patent application and its requirements.

Various modifications to the preferred embodiment and to the generic principles and features described herein will be readily apparent to those skilled in the art. Thus, the present invention is not intended to be limited to the embodiments shown but is to be accorded the widest scope consistent with the principles and features described herein.

Figure 1:
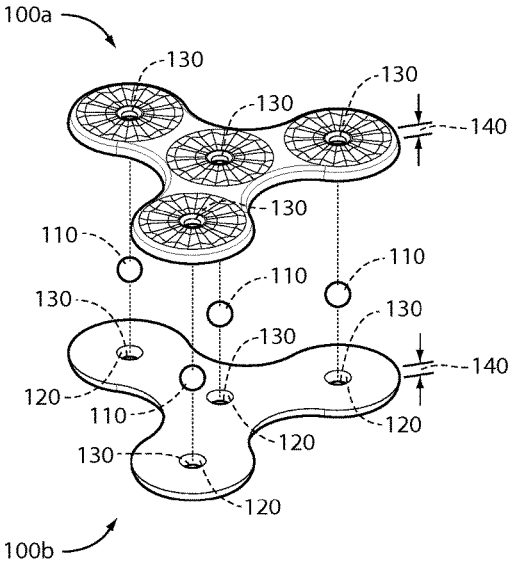
FIG. 1 illustrates an exploded view of one structural body embodiment with four magnetic nodes.

FIG. 1 illustrates an exploded view of two structural body components 100*a* and 100*b* coming together (e.g., to attach "temporarily" or "permanently"), capturing four spherical permanent dipole magnets 110 within corresponding pockets 120. Each pocket 120 has an outward-facing opening with a restricted aperture 130 extending through respective structural body components 100*a* and 100*b*, allowing captive magnet 110 to extend through wall thickness 140 of structural body components 100*a* and 100*b* while being rotatably retained within a cavity produced by facing pockets 120, as further detailed in FIG. 5.

Figure 2:
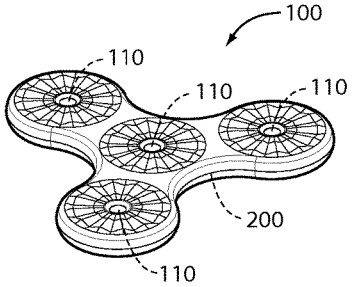
FIG. 2 illustrates the permanently assembled state of the structural body shown in FIG. 1.

FIG. 2 illustrates structural body components 100*a* and 100*b* attached to create structural body 100, rotatably capturing four permanent dipole magnets 110, allowing each of the magnets 110 to freely rotate into polar alignment with like magnets 110 in adjacent (nested or stacked) structural bodies. As a result, magnetic coupling of structural bodies may be achieved without regard to the polar orientation of magnets 110, and the contact or close proximity of respective magnets 110 maximizes a magnetic coupling force extending between contacting/close magnets 110. This magnetic coupling force joins one structural body to another structural body as described herein. Among other advantages, this magnetically self-aligning capability means that any part (e.g., structural body 100) may be flipped over and magnetically coupled using either side, whereby any non-symmetrical parts do not require 'left' and 'right' versions for symmetrical constructions.

Structural body portions such as 100*a* and 100*b* may be made from a wide variety of materials, such as plastic (including bio-plastic resins and plastic hybrids containing wood or other organic materials), wood, synthetic compounds, non-magnetic materials including non-ferrous metal such as aluminum, and the like, to name a few. In one embodiment of the present invention, structural body components 100*a* and 100*b* are made via injection molding from a hard plastic such as polycarbonate, and are attached near edge (or perimeter) 200 of the respective body components via ultrasonic welding, a process well understood by those skilled in the art of injection molding and plastics processing. Other attachment methods such as fasteners, snap features, or adhesive could be used in lieu of, or in combination with the welding process.

Figure 3:
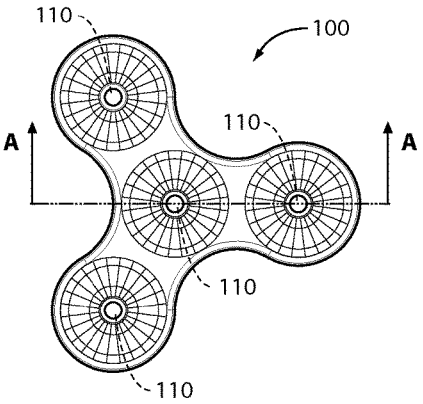
FIG. 3 illustrates a top view of the structural body of FIG. 2.

FIG. 3 illustrates a top view of the structural body 100 of FIG. 2.

Figure 4:
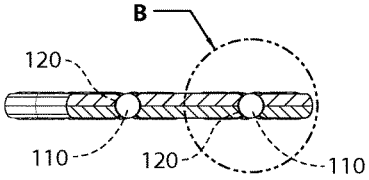
FIG. 4 illustrates a cross section view of the structural body of FIG. 3, taken through line A-A in FIG. 3.

FIG. 4 illustrates a section view of the structural body 100 of FIG. 3, taken through line A-A in FIG. 3. Magnets 110 are rotatably captured within pockets 120 and free to move, swivel, and orient about any axis passing through their respective geometric centers.

Figure 5:
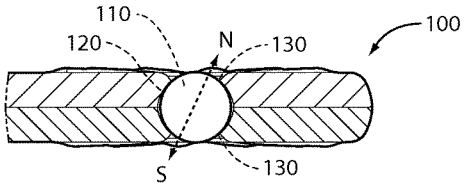
FIG. 5 illustrates a detail view of the cross section of FIG. 4, showing a magnet rotatably captured within a corresponding retaining pocket in the structural body.
Figure 6:
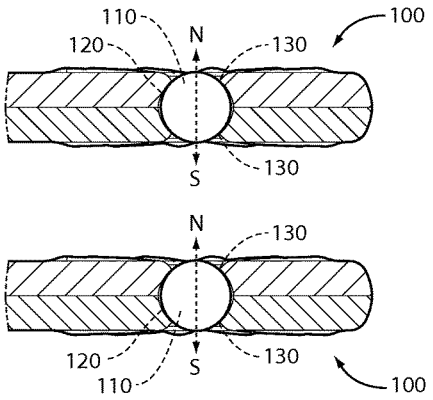
FIG. 6 illustrates the cross section detail view of FIG. 5, with an additional structural body moving into a state of magnetic coupling, causing rotation of both magnets to achieve alignment of their magnetic polarities.
Figure 7:
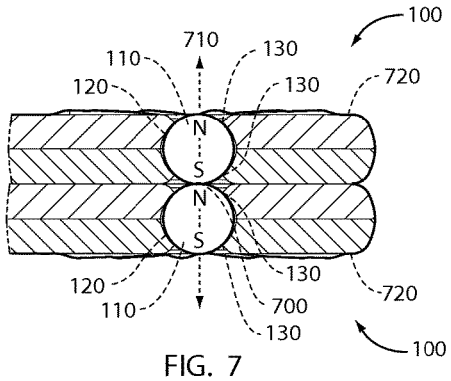
FIG. 7 illustrates the cross section detail view of FIG. 6 with the two structural bodies in a magnetically coupled state.

FIG. 5 illustrates a detail of the section view of FIG. 4. Clearance between each magnet 110 and pocket 120 allows a captured magnet 110 to freely move, swivel, and orient to align its polarity coaxial and opposed to that of a magnet 110 in an adjacent structural body 100, as shown in FIG. 6 and FIG. 7. (In the figures, unless the context provides a different interpretation, "N" refers to a north magnetic pole and "S" refers to a south magnetic pole of a particular magnet 110.)

FIG. 6 illustrates the detail view of FIG. 5, with an additional structural body 100 approaching for magnetic coupling. As magnetic fields of each magnet 110 overlap sufficiently to overcome the static friction between each magnet 110 and respective pocket 120, the magnets 110 self-align to an orientation of coaxially aligned and opposed polarity (e.g., a north pole of one magnet 110 touching or proximate a south pole of another magnet 110 of a joining structural body 100). As shown in FIG. 7, once structural bodies 100 have been magnetically coupled, magnets 110 may contact at point 700, and a resulting shared magnetic polar axis 710 is oriented substantially perpendicular to a substantially planar rim surface 720 of each structural body.

An upper limit for a diameter of aperture 130 is governed by the need to securely retain each magnet 110 and is related to a diameter of spherical magnet 110; if the diameter of aperture 130 is too close to the diameter of magnet 110, there will be a risk of magnet 110 becoming dislodged from its corresponding structural body 100. The specific properties of the material chosen for structural body 100 also influence this upper diameter limit, beyond which magnets could be dislodged from the structural body via material deflection or failure. The lower limit for the diameter of aperture 130 is governed by the desire to allow coupled magnets 110 to either contact or to come within close proximity to one another, maximizing magnetic coupling strength. Additionally, functional molding considerations such as minimum moldable wall thickness limit aperture 130 from being too small. Within these two bounds there is a range of acceptable diameter values suitable for any particular magnet diameter and suitable structural body material.

Further, for any specific diameter of aperture 130, the depth of aperture 130 within structural body 100 should correspondingly prevent magnet 110 from protruding significantly beyond substantially planar rim surface 720. As shown in FIG. 7, the coupling of two magnets thereby constrains their respective structural bodies in close proximity to provide stability to constructions. Conversely, aperture 130 should not retain each magnet 110 too deep within its corresponding structural body, thereby diminishing magnetic coupling strength by preventing magnets 110 from magnetically coupling in close proximity. With aperture 130 thus controlled, pocket 120 can be oversized, and of any shape, to aid in preventing foreign contaminants such as sand from interfering with the rotation of magnets 110.

Figure 8:
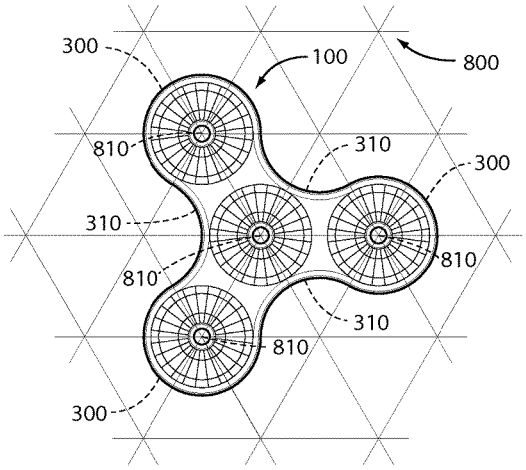
FIG. 8 illustrates the equilateral triangle pattern basis underlying structural body geometry.

As illustrated in FIG. 8, magnet locations within structural body 100, and within other structural bodies according to the present invention disclosure, are driven by an underlying pattern 800 of efficiently nested, equal-sized equilateral triangles, wherein triangle vertexes represent possible locations for magnets 110 within the structural bodies. The scale of a triangle side in pattern 800, which substantially equates to the diameter of a node (shown as radius 300), is preferably an even multiple of the diameter of magnet 110, such that the diameter of a node approximates an integer value of stacked structural body thicknesses. As a result, a node on edge (facilitated by structural bodies such as those seen in FIGS. 21-24) may fit closely between structural body layers. In one preferred embodiment, magnet 110 is a spherical neodymium magnet approximately 6.5 mm in diameter, providing a desirable amount of force for magnetic coupling, and node diameter is approximately 32.5 mm, making it large enough to alleviate choking hazard concerns.

Figure 9:
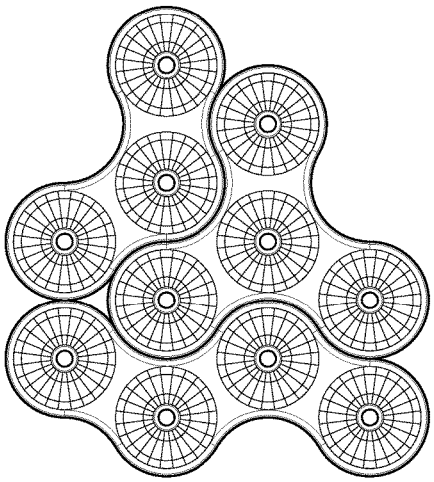
FIG. 9 illustrates several structural bodies in a laterally nested configuration according to the underlying pattern of FIG. 8.

The geometric form of structural bodies is also generally governed by pattern 800, whereby: a) any convex structural body radius 300 is substantially equal to half the length of a side of a triangle within pattern 800, and has a vertex as a center point; b) any concave radius 310 is substantially equal to radius 300, and has a vertex as a center point; c) magnets 110 are coincident with vertex locations of pattern 800, and; d) magnetically coupled structural bodies share the same underlying pattern 800. As seen in FIG. 9, having these interacting complementary "convex" and "concave" surfaces allows multiple structural bodies to closely nest with perimeter surfaces supporting one another, thereby distributing part weight or load over a larger number of magnets 110 and increasing structural strength. Referring to FIGS. 10-20, a structural body form may therefore be a single node as in FIG. 10; a linear string of integer M number of nodes, M>1 (M=2-4 illustrated in FIGS. 11-13); or other forms derived from this 60-degree pattern 800 in which two or more nodes define an axis and one or more other nodes lie off this axis by 60-degrees or 120-degrees, as seen in the examples of FIGS. 14-20. The representative arrangements of nodes illustrated in the figures are not exhaustive and other combinations and arrangements of nodes that are consistent with pattern 800 are possible. Any part may be flipped over and magnetically coupled to any other part, as magnets will automatically rotate into magnetic alignment. When two structural parts are coupled together into an assembly and associated corresponding magnets have self-aligned, another structural body to be coupled to the assembly will have its magnets align with the magnet orientation established by the assembly. Any discrete solitaire structural body may likewise be added into an assembly as the magnets are free to align to the appropriate magnetic axes of corresponding magnets of the assembly.

Figure 21:
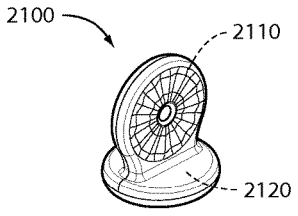
FIGS. 21-22 illustrate a structural body with one magnetic node substantially perpendicular to another.
Figure 22:
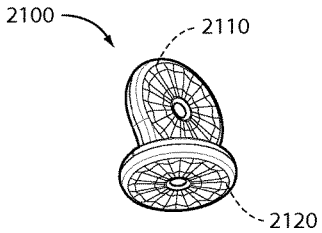
Figure 23:
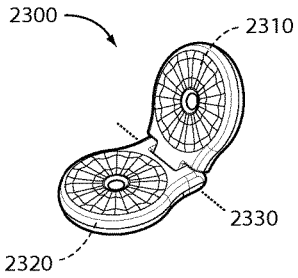
FIG. 23 illustrates a structural body with a hinge feature between magnetic nodes.
Figure 24:
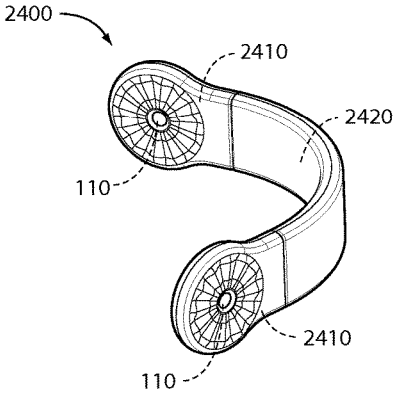
FIG. 24 illustrates two magnetic nodes flexibly attached by an elastomeric interconnecting member.

FIGS. 21-24 illustrate structural body forms enabling construction on intersecting planes, thereby allowing the underlying structure of pattern 800 of FIG. 8 to apply to multiple planes within a single structure. In FIGS. 21-22, structural body 2100 has a face 2110 oriented substantially perpendicular to substantially planar face 2120, allowing construction to accordingly shift to rotationally offset planes. FIG. 23 illustrates a hinged structural body 2300, enabling magnetic node 2310 to pivot out-of-plane with respect to magnetic node 2320 along an axis 2330. FIG. 24 illustrates a structural body 2400 with each end node 2410 attached to an elastomeric central member 2420, allowing end nodes 2410 to be freely twisted or curved with respect to one another.

Figure 10:
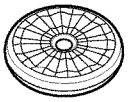
FIGS. 10-20 illustrate embodiments of substantially flat structural body geometries.
Figure 11:
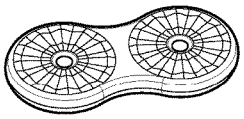
Figure 12:
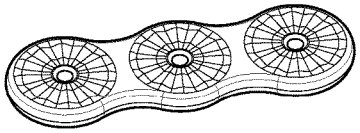
Figure 13:
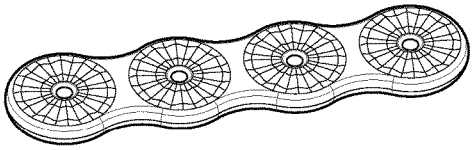
Figure 14:
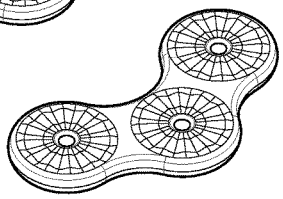
Figure 15:
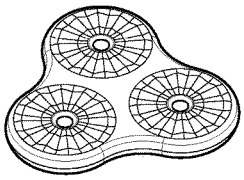
Figure 16:
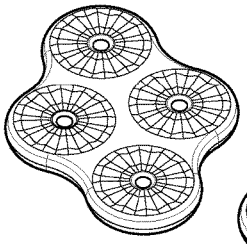
Figure 17:
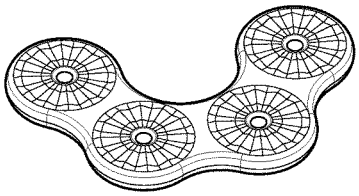
Figure 18:
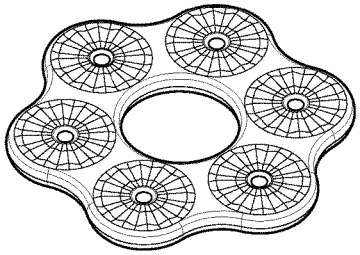
Figure 19:
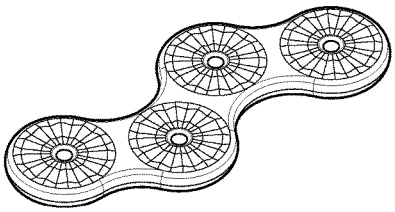
Figure 20:
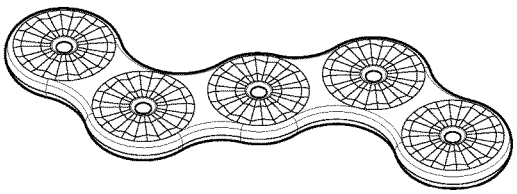
Figure 25:
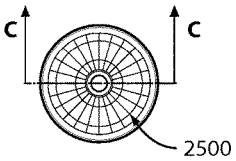
FIG. 25 illustrates a top view of the structural body of FIG. 10, with section line C-C intersecting peak amplitude in the undulating surface of the structural body.
Figure 26:
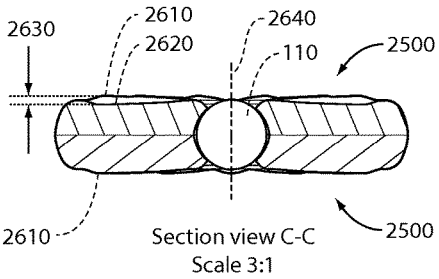
FIG. 26 illustrates a cross section detail view of the structural body of FIG. 25, taken through line C-C in FIG. 25.

FIG. 25 shows a top view of the structural body of FIG. 10, with a section line C-C passing through the structural body where an undulating surface 2500 is at its highest point of amplitude on one side of the part, corresponding with its lowest point of amplitude on the opposed side. As further illustrated in the section view detail of FIG. 26, the surface 2500 surrounding magnet 110 has alternating protrusions 2610 and recesses 2620 of a consistent amplitude 2630 repeated at regular intervals around a central axis 2640, creating a hermaphroditic detent feature common between magnetic nodes of multiple structural bodies. As a result, any surface 2500 is able to nest into any other surface 2500 of another structural body, with respective magnets 110 pulling each protrusion 2610 into a corresponding recess 2620 to provide lateral and rotational stability. Furthermore, when a rotational force is applied between the structural bodies of magnetically coupled nodes, the structural bodies may rotate relative to one another about any shared magnetic axis in an indexed or clicking manner without magnetically decoupling. This rotation requires magnets 110 and corresponding structural bodies to have a varying separation distance during rotation (as a protrusion moves from a depth of a recess toward an adjacent protrusion and then back into the same or adjacent recess), against the coupling force of magnets 110, in order for each protrusion 2610 of one structural body to climb over each corresponding protrusion 2610 on the magnetically coupled structural body, after which the magnetic coupling force pulls the structural bodies back together into the next stable position of seated detents. Detent surface 2500 thereby serves two functions: 1) it provides rotational stability between magnetically coupled nodes, and therefore structural stability to constructions, and; 2) it ensures that the shared magnetic axis of coupled magnets 110 is substantially perpendicular to the structural bodies, preventing or inhibiting structural bodies from sliding laterally about their respective coupled surfaces and thereby maintaining respective alignment of structural bodies consistent with underlying pattern 800.

In at least one embodiment, undulating surface 2500 may be described as a radial sine wave, also known as a sinusoidal wave, with its smooth and repetitive oscillation occurring radially about axis 2640 running through the center of each node containing a magnet 110. The smooth transitional nature of this form allows intentional rotation between like surfaces 2500 of structural bodies while minimizing the risk of unintentional magnetic decoupling. However, the exact geometry of detent surface 2500 can take any one of numerous forms and similarly serve to provide discreet rotational clicks and corresponding rotational stability.

Amplitude 2630 between protrusions 2610 and recesses 2620 of surface 2500, in wave or other form, governs a corresponding increase or decrease in tactility of the detent clicking when structural bodies are rotated with respect to one another about the shared magnetic axis of coupled nodes. An increase in amplitude 2630 means respective rotation of structural bodies involves a greater transitional separation of detent surfaces 2500, requiring more force. However, a greater separation of magnets 110 reduces magnetic coupling force, and if this amplitude is too large as compared to the magnetic coupling force, structural bodies are more apt to become inadvertently decoupled. Conversely, if the amplitude is too small, the detent surface 2500 may provide insufficient resistance against unwanted rotation between nodes, and may compromise the structural stability of constructed forms. Therefore, these two considerations govern a suitable range of values for amplitude 2630. In at least one embodiment, said amplitude 2630 has a value between 1 mm and 3 mm when system architecture is based on a neodymium magnet with a diameter of approximately 6.5 mm.

Further, detent surface 2500 is clocked in relation to underlying pattern 800 such that any magnetically coupled structural body may be flipped 180 degrees over any line of pattern 800 and reseated into the corresponding surface 2500 of the other structural body in a hermaphroditic (e.g., complementary) manner. This architecture requires that the mid-point of consistent amplitude 2630 is clocked to align with underlying pattern 800. In at least one embodiment, a full cycle of amplitude has a frequency, or pitch, such that a detent stop is provided every 30 degrees of rotation about the axis of magnetically coupled parts. This rotational angle between detents may be greater or smaller, but preferably is an even divisor into 60 degrees, the basis of pattern 800, so that magnetically coupled parts experience indexed stops capable of aligning with pattern 800.

Figure 27:
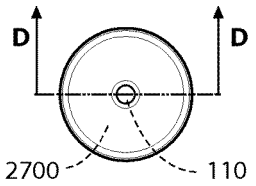
FIG. 27 illustrates a top view of an alternate structural body embodiment with a sunken surface around each magnetic node.
Figure 28:
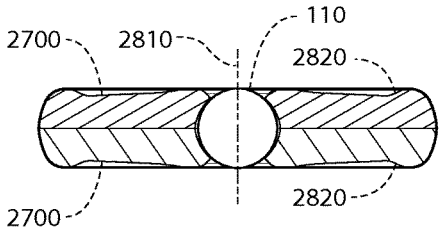
FIG. 28 illustrates a cross section detail view of the structural body of FIG. 27, taken through line D-D in FIG. 27.

FIG. 27 illustrates a top view of a second node surface geometry with a radially recessed surface 2700 around magnet 110. FIG. 28 illustrates a cross-section view of the structural body of FIG. 27, taken through line D-D in FIG. 27. As shown, radial recessed surface 2700 about a central axis 2810 is sufficiently deep to clear all protrusions 2610 of any magnetically coupled detent surface 2500, thereby allowing free rotation between respective nodes without indexed stops. Therefore, a structural body with a radial recessed surface 2700 on either or both sides of any node, when placed between two magnetically coupled detent surfaces 2500, may transform the rotational behavior from one with detent clicks to one which is freely rotatable. A sloped transition surface 2820 helps to center all protrusions 2610 of any magnetically coupled detent surface 2500 within the radially recessed surface 2700, thereby providing lateral stability and ensuring respective magnets 110 are coupled with a shared magnetic axis predominantly perpendicular to the structural bodies, these structural bodies all conforming to pattern 800.

Figure 29:
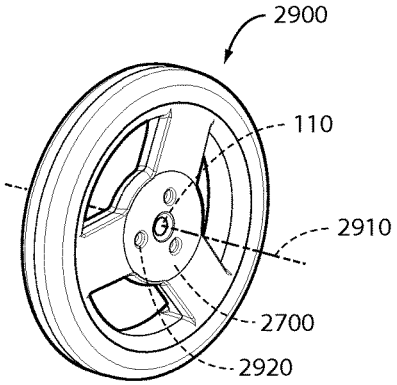
FIG. 29 illustrates one side of an alternate structural body embodiment which incorporates the sunken surface of FIGS. 27-28, providing a free-spinning wheel which uses the axis of magnetic coupling as the axis of rotation.

FIG. 29 illustrates a wheel embodiment 2900 incorporating radial recessed surface 2700 to enable free rotation about an axis 2910 of magnetic coupling. An additional recess feature 2920 in one or more locations may provide a positive engagement feature for an optional motor drive coupling, wherein magnet 110 provides an attractive force to the motor drive coupling, and recess feature 2920 prevents unwanted relative rotation between the motor drive coupling and wheel 2900.

Figure 30:
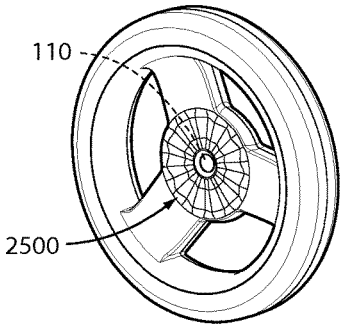
FIG. 30 illustrates the other side of the structural embodiment of FIG. 29.

FIG. 30 illustrates an opposite side of the wheel embodiment of FIG. 29, incorporating undulating surface 2500.

Figure 31:
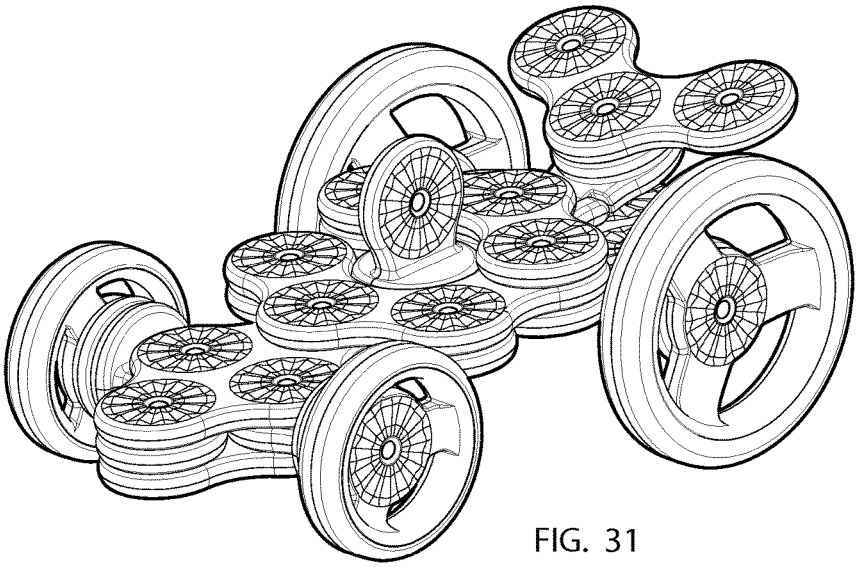
FIG. 31 illustrates an example construction made from various structural bodies according to the present invention.

FIG. 31 illustrates an example construction according to the system and method of the present invention. Wheel embodiments used in a single assembly are shown having differing diameters (though some implementations will include all wheels having the same diameter).

Figure 32:
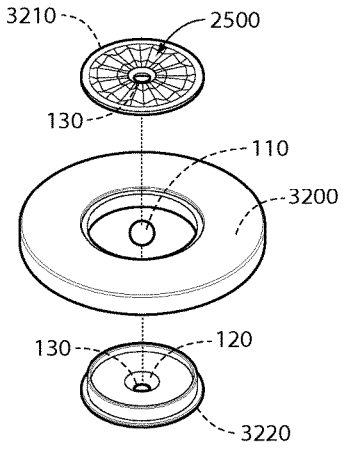
FIG. 32 illustrates an exploded view of an alternate embodiment in which spherical magnets are captured via separate retention rings.
Figure 33:
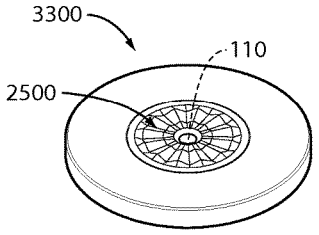
FIG. 33 illustrates a collapsed view of the embodiment of FIG. 32.
Figure 34:
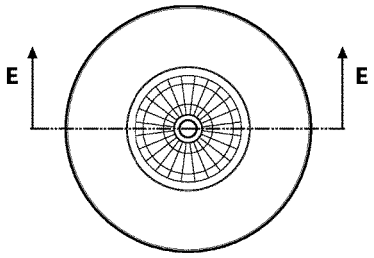
FIG. 34 illustrates a top view of the embodiment of FIG. 33.
Figure 35:
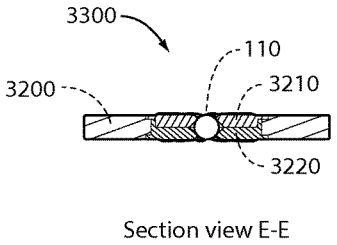
FIG. 35 illustrates a cross section view of the embodiment of FIG. 34 taken through line E-E of FIG. 34.

The disclosed invention readily lends itself to multiple variations. FIG. 32 illustrates an exploded view of an alternate embodiment, in which each magnet 110 may be rotatably captured by a first retaining ring 3210 and a second retaining ring 3220 which together form magnet pocket 120 with aperture 130, as previously disclosed. In this architecture, these retaining rings may incorporate surface 2500, thereby allowing a separate structural portion 3200 to be made of a material such as wood, which may be less suitable for the fine tolerances required of surface 2500. FIG. 33 illustrates the assembled state of the components of FIG. 32, with retaining rings 3210 and 3220 capturing magnet 110 within structural portion 3200 to create a structural body 3300. FIG. 34 shows a top view of the embodiment of FIG. 33, while FIG. 35 illustrates a cross section view of the embodiment of FIG. 34, taken through line E-E of FIG. 34, showing magnet 110 rotatably retained.

Figure 36:
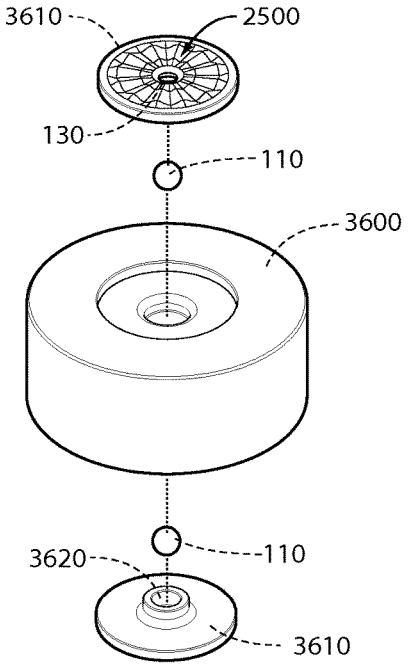
FIG. 36 illustrates an exploded view of an alternate embodiment in which magnets are contained within pockets on multiple faces of a structural body, and each magnet is exposed on only one face.
Figure 37:
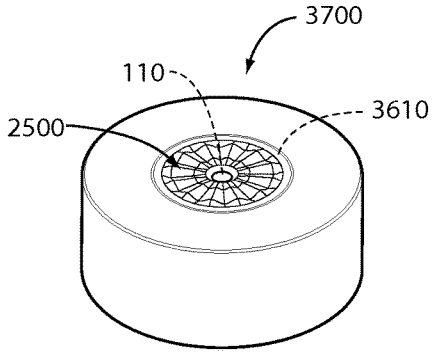
FIG. 37 illustrates a collapsed view of the embodiment of FIG. 36.
Figure 38:
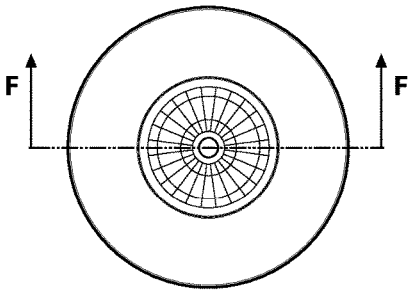
FIG. 38 illustrates a top view of the embodiment of FIG. 37.
Figure 39:
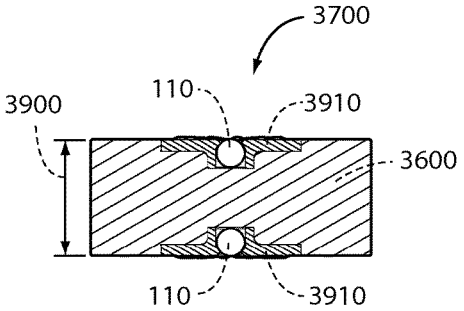
FIG. 39 illustrates a cross section view of the embodiment of FIG. 38, taken through line F-F of FIG. 38.

In a further variation shown in FIG. 36, each magnet 110 may be rotatably retained within a separate face of a structural body 3600 by a retaining ring 3610 which exposes magnet 110 on only one face. FIG. 37 illustrates the components of FIG. 36 assembled to create a structural body 3700, with surface 2500 integrated into each retaining ring 3610. FIG. 38 shows a top view of the structural body of FIG. 37, while FIG. 39 illustrates a cross section of the same body as taken through line F-F in FIG. 38. As shown, this architecture allows body 3700 to have an increased thickness 3900 without a proportionate increase in diameter and associated cost of magnet 110. In keeping with the present invention, magnet 110 is free to rotate about any axis extending through its center and may thereby self-align with other like magnets.

Figure 40:
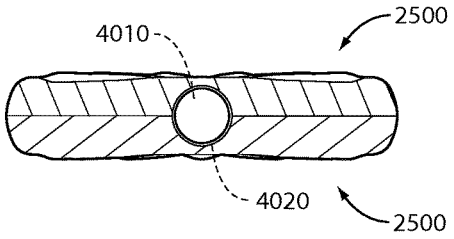
FIG. 40 illustrates a cross section detail view of an alternate embodiment in which a rotatably retained magnet is fully encapsulated by an associated structural body.

In an alternate embodiment, shown in FIG. 40, a spherical permanent dipole magnet 4010 is rotatably captured and fully encapsulated within a retaining pocket 4020, and surface 2500 is incorporated into the external nodal faces as according to the present invention disclosure.

Figure 41:
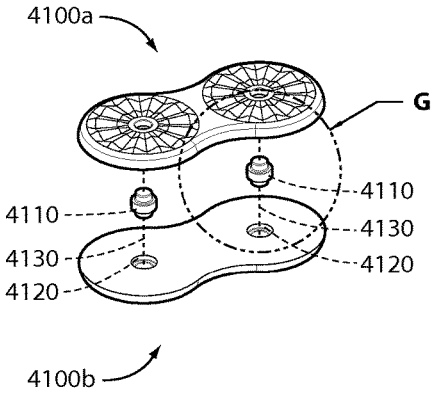
FIG. 41 illustrates an exploded view of an alternate embodiment in which each magnet is pivotally constrained within a retaining pocket.
Figure 42:
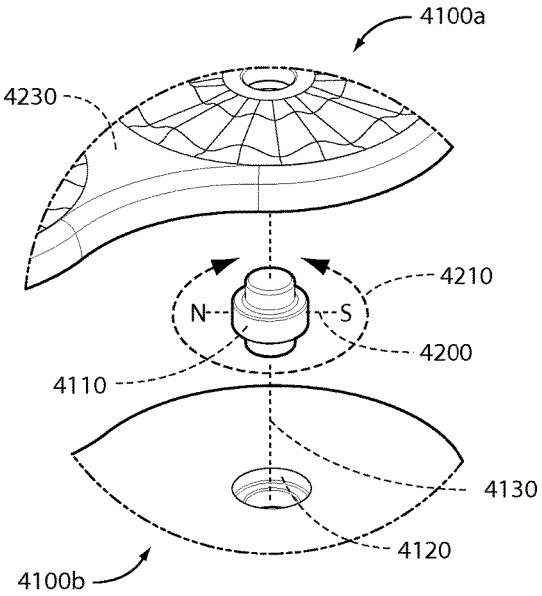
FIG. 42 illustrates a detail view of the embodiment of FIG. 41, showing the magnet polarity perpendicular to the geometric axis of rotation.
Figure 43:
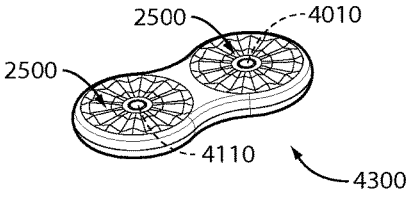
FIG. 43 illustrates an assembled state of the embodiment of FIGS. 41-42.
Figure 44:
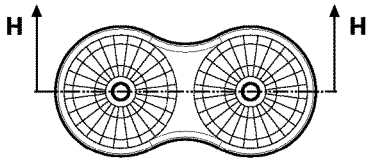
FIG. 44 illustrates a top view of the embodiment of FIG. 43.
Figure 45:
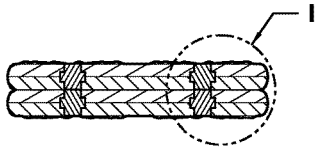
FIG. 45 illustrates a section view of the embodiment of FIG. 44, taken through line H-H of FIG. 44, with a second like structural body magnetically coupled.

In another embodiment, shown in FIG. 41, a structural body component 4100*a* may join with a structural body component 4100*b* to pivotally capture a magnet 4110 within a retaining pocket 4120. As illustrated in the associated Detail G of FIG. 42, each magnet 4110 may have a polarity 4200 substantially perpendicular to its geometric axis 4130, such that the polarity 4200 is constrained to a rotation 4210 about axis 4130, wherein polarity 4200 remains substantially parallel with the surface 4230 of its captive structural body. FIG. 43 shows an assembled view of the components of FIG. 42, creating a structural body 4300 with detent surfaces 2500 around each magnet 4110. FIG. 44 shows a top view of structural body 4300 of FIG. 43, and FIG. 45 illustrates a section view of body 4300 taken though line H-H of FIG. 44, with a second structural body 4300 magnetically coupled. As shown in the detail view of FIG. 46, an exposed portion of magnet 4110 extends through thickness 4610 of each respective structural body to maximize magnetic coupling force. The ability of each magnet 4110 to pivot within its captive structural body allows magnets 4110 to self-align to an orientation of parallel and opposed magnetic poles, and also allows rotation between magnetically coupled nodes.

Figure 46:
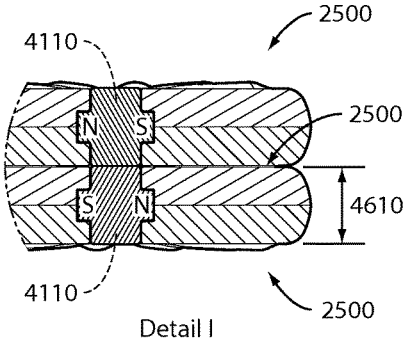
FIG. 46 illustrates a detail view of cross section of FIG. 45.
Figure 47:
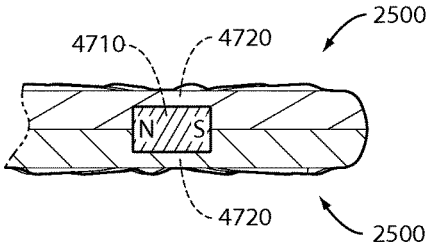
FIG. 47 illustrates an alternate embodiment in which a captive magnet, with the polarity of the magnet of FIG. 46, is fully encapsulated.

FIG. 47 illustrates a partial view of an alternate embodiment with the same magnet polarity as shown in FIG. 46, but with a magnet 4710 fully encapsulated by material thickness 4720.

Figure 48:
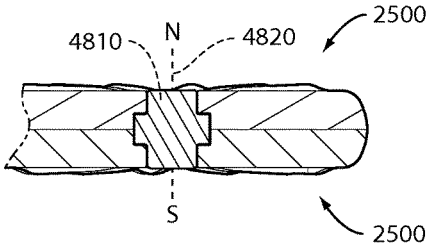
FIG. 48 illustrates an alternate embodiment in which magnet polarity is oriented substantially perpendicular to the surface of the captive structural body.

FIG. 48 illustrates a partial view of an alternate embodiment with a magnet 4810 with a magnetic polarity 4820 fixed or pivotally constrained perpendicular to the substantially planar structural body surface. In this arrangement, polarity of structural bodies must be aligned for magnetic coupling, which may be useful for games or puzzles, while exposed magnets 4810 maximize magnetic coupling force and each surface 2500 provides rotational stops between magnetically coupled nodes, according to the present invention disclosure.

Figure 49:
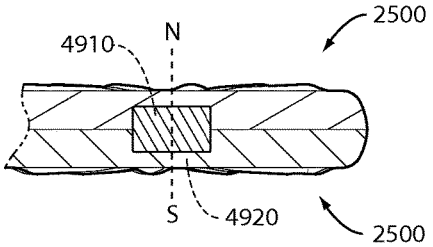
FIG. 49 illustrates an alternate embodiment in which a captive magnet, with the polarity of the magnet of FIG. 48, is fully encapsulated.

FIG. 49 illustrates a partial view of an alternate embodiment with the same magnet polarity as shown in FIG. 48, but with a magnet 4910 fully encapsulated by material thickness 4920.

Figure 50:
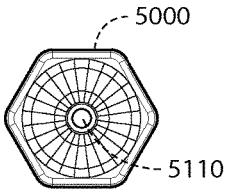
FIG. 50 illustrates an alternate embodiment in which the geometry of each magnetic node is based on a hexagon.

FIG. 50 illustrates an alternate architectural embodiment based upon a polygonal (e.g., hexagonal) perimeter 5000 around each magnet 5110, rather than circular.

Figure 51:
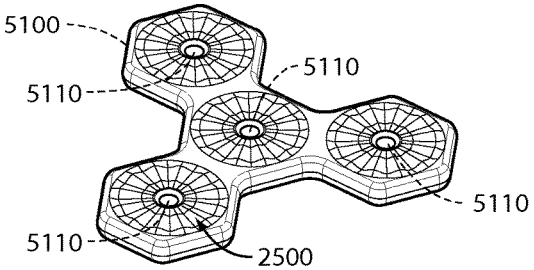
FIG. 51 illustrates an isometric view of a structural body based on the nodal architecture of FIG. 50.

FIG. 51 illustrates an example structural body embodiment consistent with the polygonal node architecture of FIG. 50. Outer perimeter 5100 and locations of magnets 5110 conform to the underlying pattern 800 previously disclosed, allowing perimeter 5100 to closely nest with perimeter sections of other structural bodies based on the same polygonal architecture. Surface 2500 may optionally be incorporated into respective structural bodies as shown, but is not required in some implementations to achieve rotational stability since nested linear edge segments may constrain rotation of respective structural bodies.

Figure 52:
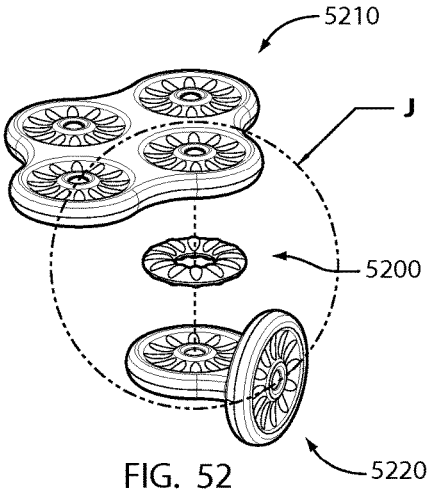
FIG. 52 illustrates an exploded view of structural bodies incorporating an alternate nodal surface geometry with sunken detent surfaces which can receive an optional intermediate detent ring to provide detent stops.
Figure 53:
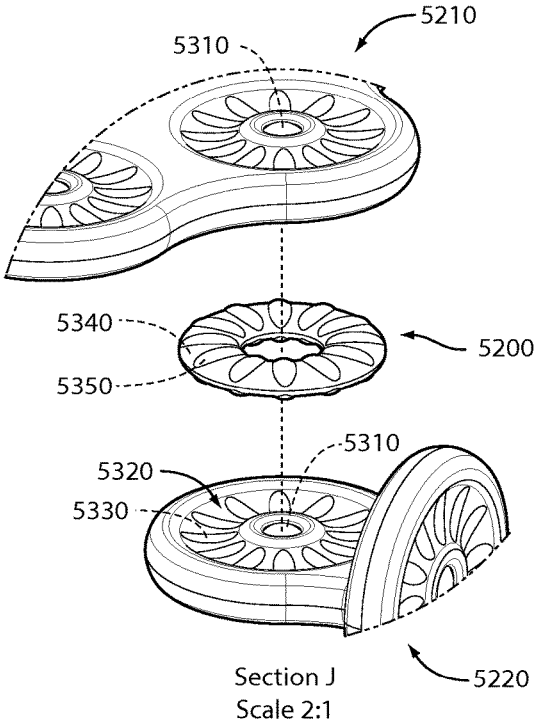
FIG. 53 illustrates a detail of the exploded view of FIG. 52.
Figure 54:
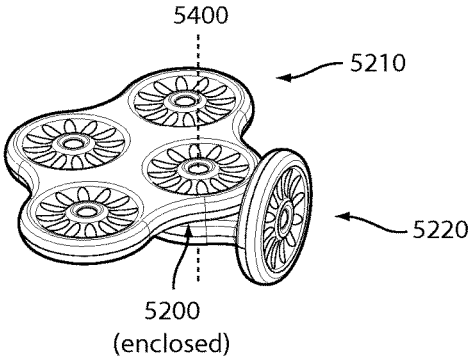
FIG. 54 illustrates a collapsed view of the assembly of FIGS. 52-53, with the detent ring securely captured between magnetically coupled structural bodies.

FIG. 52 illustrates an alternate embodiment. As shown in the corresponding detail view of FIG. 53, the outer surface of each structural body, such as illustrated by examples 5210 and 5220, may be sunken in a radial pattern 5320 around the axis of each respective magnet 5310, whereby: the geometry of the recess includes a further sunken recess 5330, radial patterns 5320 and sunken recesses 5330 each corresponding with a substantially similar respective surface 5340 and 5350 on each side of a second structural detent ring 5200, with detent ring 5200 capable of nesting between any two magnetically coupled structural bodies, as shown in FIG. 54. When in this enclosed or encapsulated position, detent ring 5200 thereby restricts structural bodies to rotation only in an indexed, or clicking fashion, and when it is removed, free rotation of respective bodies is enabled. In another related embodiment, engaging detent topographies may be reversed, whereby feature 5330 is instead raised within sunken surface 5320, and corresponding detent ring surface 5350 is sunken within surface 5340 to accordingly engage in a detent manner.

As used herein, a permanent magnet is an article of manufacture or other object made from a magnetized material that creates its own persistent magnetic field. As used herein, dipole, as in permanent dipole magnet, refers to two intrinsic poles of the permanent magnet: a north (magnetic) pole and an associated south (magnetic) pole with a magnetic dipole moment pointing from the magnetic south pole to the magnetic north pole. When referring to an embodiment of the present invention, a magnet refers to a permanent magnet with a pair of associated magnetic poles having an intrinsic magnetic dipole moment pointing from a south pole to a north pole.

The system and methods above have been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A magnetic construction apparatus, comprising:

a planar body including a planar bottom surface, a top surface spaced apart from and parallel to said bottom surface, and a side surface extending between said bottom surface and said top surface, said side surface having a height and defining a closed loop perimeter around said bottom surface wherein said perimeter consists essentially of a plurality of alternating convex circular arc portions and concave circular arc portions, each said portion having a substantially equal radius and a centerpoint disposed at a vertex of an equilateral triangular grid pattern and having a subtended arc angle with an integer multiple of 60 degrees, said planar body further including a plurality of cavities, each cavity disposed at a particular one vertex of said equilateral triangular grid pattern; and a magnetic element disposed within each said cavity of said plurality of cavities.

2. The apparatus according to claim 1, wherein each said magnetic element is configured to rotate within its cavity about any axis extending through said magnetic element.

3. The apparatus according to claim 2, wherein said magnetic element includes a spherical outer surface.

4. The apparatus according to claim 1, wherein each said cavity defines a first aperture in said bottom surface and a second aperture in said top surface, each said aperture exposing a portion of said magnetic element retained within said cavity.

5. The apparatus according to claim 1, wherein a portion of each surface centered on each said cavity defines a mating surface and wherein each said mating surface includes a radial detent structure consisting essentially of a periodic set of protrusions and recesses centered on any said cavity.

6. The apparatus according to claim 5, wherein said set of protrusions and recesses occurs at a pitch frequency including an integer multiple of 15 degrees.

7. The apparatus according to claim 1, wherein a portion of each surface centered on each said cavity defines a mating surface and wherein a particular one of said mating surfaces includes a 360 degree radially recessed surface centered on its associated cavity.

8. The apparatus according to claim 1, wherein a length of a triangle leg in said triangular grid pattern is an integer multiple of a length dimension between said bottom surface and said top surface.

9. A magnetic construction system, comprising:

a plurality of magnetic connector bodies configured for mutual magnetic connection one to another along mutually confronting, substantially planar faces of said magnetic connector bodies, wherein each said magnetic connector body comprises:

a body including a bottom face, a top face spaced apart from and parallel to said bottom face, and a side surface extending between said faces, said side surface having a height and defining a closed loop perimeter around said faces, wherein said perimeter consists essentially of a plurality of alternating convex circular arc portions and concave circular arc portions, each said portion having a substantially equal radius and a centerpoint disposed at a vertex of an equilateral triangular grid pattern and having a subtended arc angle with an integer multiple of 60 degrees, said planar body further including a plurality of cavities, each cavity disposed at a particular one vertex of said equilateral triangular grid pattern; and a magnetic element disposed within each said cavity of said plurality of cavities.

10. The system according to claim 9, wherein each said magnetic element is configured to rotate within its cavity about any axis extending through said magnetic element.

11. The system according to claim 10, wherein said magnetic element includes a spherical outer surface.

12. The system according to claim 9, wherein each said cavity defines a first aperture in said bottom surface and a second aperture in said top surface, each said aperture exposing a portion of said magnetic element retained within said cavity.

13. The system according to claim 9, wherein a portion of each surface centered on each said cavity defines a mating surface and wherein each said mating surface includes a radial detent structure consisting essentially of a periodic set of protrusions and recesses centered on any said cavity.

14. The system according to claim 13, wherein said set of protrusions and recesses occurs at a pitch frequency including an integer multiple of 15 degrees.

15. The system according to claim 9, wherein a portion of each surface centered on each said cavity defines a mating surface and wherein a particular one of said mating surfaces includes a 360 degree radially recessed surface centered on its associated cavity.

16. The system according to claim 9, wherein a length of a triangle leg in said triangular grid pattern is an integer multiple of a length dimension between said bottom surface and said top surface.

17. The system according to claim 9 including a first particular magnetic connector body having a first configuration and a second particular magnetic connector body having a second configuration different from said first configuration, wherein said configurations include a number of magnetic element containing cavities and include a spatial layout of said number of magnetic element containing cavities.

18. A magnetic construction system, comprising:

a plurality of magnetic connector bodies configured for mutual magnetic connection one to another using mutually confronting, substantially planar faces of said magnetic connector bodies, wherein each said magnetic connector body comprises:

a body including a bottom face, a top face spaced apart from and parallel to said bottom face, and a side surface extending between said faces, said side surface having a height and defining a closed loop perimeter around said faces, wherein said perimeter consists essentially of a plurality of alternating convex circular arc portions and concave circular arc portions, each said portion having a substantially equal radius and a centerpoint disposed at a vertex of an equilateral triangular grid pattern and having a subtended arc angle with an integer multiple of 60 degrees, said planar body further including a plurality of cavities disposed inside said perimeter, each said cavity disposed at a particular one vertex of said equilateral triangular grid pattern; and a magnetic element disposed within each said cavity of said plurality of cavities; and wherein a first set of said plurality of magnetic connector bodies include a first number N of said cavities disposed within said perimeter, N>1; and wherein a second set of said plurality of magnetic connector bodies include a second number M of said cavities disposed within said perimeter, M>1 and M≠N.

19. The system according to claim 18 wherein each said magnetic element includes a pole orientation direction from a south pole to a north pole, wherein a combination of each said cavity and said disposed magnetic element is cooperatively configured for permitting a rotation of said disposed magnetic within its cavity about any axis extending through said disposed magnetic element, and wherein said rotation changes said pole orientation direction of said disposed magnet.

* * * * *